US005725993A

United States Patent [19]

Bringley et al.

[11] Patent Number: 5,725,993

[45] Date of Patent: Mar. 10, 1998

[54] LASER ABLATIVE IMAGING ELEMENT

[75] Inventors: Joseph F. Bringley; David P. Trauernicht; Patrick M. Lambert, all of Rochester, N.Y.

[73] Assignee: Eastman Kodak Company, Rochester, N.Y.

[21] Appl. No.: 764,892

[22] Filed: Dec. 16, 1996

[51] Int. Cl.[6] ..... B41M 5/26

[52] U.S. Cl. ..... 430/269; 430/945; 430/200; 430/201

[58] Field of Search ..... 430/200, 201, 430/945, 270.11, 270.1, 269; 503/228

[56] References Cited

U.S. PATENT DOCUMENTS

| | | | |
|---|---|---|---|
| 3,787,873 | 1/1974 | Sato et al. | 430/945 |
| 4,245,003 | 1/1981 | Oransky et al. | 428/323 |
| 4,496,957 | 1/1985 | Smith et al. | 430/945 |
| 5,028,467 | 7/1991 | Maruyama et al. | 430/945 |
| 5,104,767 | 4/1992 | Nakamura | 430/138 |
| 5,156,938 | 10/1992 | Foley et al. | 430/201 |
| 5,326,619 | 7/1994 | Dower et al. | 430/200 |

FOREIGN PATENT DOCUMENTS

| | | | |
|---|---|---|---|
| 62-151394 | 7/1987 | Japan | 430/270.11 |
| 64-45689 | 2/1989 | Japan | 430/270.11 |
| 3-53984 | 3/1991 | Japan | 430/270.11 |

OTHER PUBLICATIONS

The CRC Handbook of Chemistry and Physics (1982–83) p. B–99.

Kirk–Othmer Encyclopedia of Chamical Technology, Third Ed., vol. 17, pp. 375–398 ©1982.

*Primary Examiner*—Martin Angebranndt

*Attorney, Agent, or Firm*—Harold E. Cole

[57] ABSTRACT

A laser-exposed thermal recording element comprising a support having thereon a pigment layer comprising a pigment dispersed in a polymeric binder, the pigment absorbing at the wavelength of a laser used to expose the element, wherein the pigment comprises the formula:

$$M_xA_yQ_z$$

wherein:

M is at least one metal atom,

A is at least one alkali metal,

Q is at least one of oxygen or sulfur, x is an integer between 1 and 3, y is between 0 and about 2, and z is between about 1 and about 4.

6 Claims, No Drawings

LASER ABLATIVE IMAGING ELEMENT

This invention relates to laser ablative imaging elements, and more particularly to such elements which are used in medical imaging.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to one of the cyan, magenta or yellow signals. The process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

Another way to thermally obtain a print using the electronic signals described above is to use a laser instead of a thermal printing head. In such a system, the donor sheet includes a material which strongly absorbs at the wavelength of the laser. When the donor is irradiated, this absorbing material converts light energy to thermal energy and transfers the heat to the dye in the immediate vicinity, thereby heating the dye to its vaporization temperature for transfer to the receiver. The absorbing material may be present in a layer beneath the dye and/or it may be admixed with the dye. The laser beam is modulated by electronic signals which are representative of the shape and color of the original image, so that each dye is heated to cause volatilization only in those areas in which its presence is required on the receiver to reconstruct the color of the original object. Further details of this process are found in GB 2,083,726A, the disclosure of which is hereby incorporated by reference.

In one ablative mode of imaging by the action of a laser beam, an element with a dye layer composition comprising an image dye, an infrared-absorbing material, and a binder coated onto a substrate is imaged from the dye side. The energy provided by the laser drives off at least the image dye at the spot where the laser beam impinges upon the element. In ablative imaging, the laser radiation causes rapid local changes in the imaging layer thereby causing the material to be ejected from the layer. This is distinguishable from other material transfer techniques in that some sort of chemical change (e.g., bond-breaking), rather than a completely physical change (e.g., melting, evaporation or sublimation), causes an almost complete transfer of the image dye rather than a partial transfer. Usefulness of such an ablative element is largely determined by the efficiency at which the imaging dye can be removed on laser exposure. The transmission Dmin value is a quantitative measure of dye clean-out: the lower its value at the recording spot, the more complete is the attained dye removal.

Laser ablative imaging is of interest for medical applications since the advent of digital imaging techniques and because conventional silver halide film is costly and has undesirable waste products. Medical imaging films should have an optical density in the visible region between about 0.1 and 4.0. However, several problems are encountered in laser ablation printing media:

1. the image tone is considerably different from that of conventional media (i.e., silver halide) so that acceptance amongst physicians is very slow;
2. ablation media have high specular reflectance so that an observer may see a reflection of oneself in the image, making diagnosis difficult;
3. the dyes used in ablative media may have poor lightbox stability thus limiting the lifetime of the image; and
4. the dyes used in ablative imaging present a possible environmental hazard.

U.S. Pat. No. 4,245,003 discloses a laser-imageable material comprising a transparent film having thereon a dried coating comprising graphite particles and binder. The graphite particles absorb the laser irradiation and can be selectively removed to form an image. There is a problem with using carbon-black, however, in that it may "burn" upon ablation which would impart an undesirable brown tone to the image.

It is an object of this invention to provide a laser-imageable material which does not have an undesirable brown tone upon imaging. It is another object of this invention to provide a laser-imageable material which reduces specular reflection. It is yet another object of this invention to provide a laser-imageable material which has improved lightbox stability.

These and other objects are achieved in accordance with this invention which relates to a laser-exposed thermal recording element comprising a support having thereon a pigment layer comprising a pigment dispersed in a polymeric binder, the pigment absorbing at the wavelength of a laser used to expose the element, wherein the pigment comprises the formula:

$$M_xA_yQ_z$$

wherein:

M is at least one metal atom,

A is at least one alkali metal,

Q is at least one of oxygen or sulfur, x is an integer between 1 and 3, y is between 0 and about 2, and z is between about 1 and about 4.

In a preferred embodiment of the invention, M is copper or iron; A is potassium, sodium or lithium; and Q is oxygen. In another preferred embodiment, x and z are each 1 and y is 0. In still another preferred embodiment, the pigment is cupric oxide. In yet another preferred embodiment, M is iron, Q is oxygen, y is 0, x is 3 and z is about 4.

Another embodiment of the invention relates to a process of forming a single color, ablation image comprising imagewise-exposing by means of a laser, in the absence of a separate receiving element, a laser-exposed thermal recording element as described above, the laser exposure taking place through the pigment side of the element, thereby imagewise-heating the pigment layer and causing it to ablate, and removing the ablated material to obtain an image in the laser exposed thermal recording element.

By use of the invention, an image tone closely resembling that of silver halide is obtained, specular reflection of the film is eliminated or minimized, and the lightbox stability of the imaged article is improved. The pigment used in the present invention is also unreactive toward most laser dyes which is not the case for most metallic particles.

In general, the particle size of the pigment employed in the invention should be between 0.05–10 μm and the pigment-to-binder weight ratio should be between 0.25 and 5.0. In a preferred embodiment of the invention, the pigment is present in an amount of from about 0.01 $g/m^2$ to about 0.500 $g/m^2$ of the element.

Examples of pigments useful in the invention include the following:, CuO, CuS, $Cu_2S$, NiO, NiS, AgO, $Ag_2O$, AgS, SnO, $Fe_3O_4$, $CuFe_2O_4$, $NaCuO_2$, $LiMn_2O_4$, $LiCuO_2$, $La_2CuO_4$, $MoS_2$, $TaS_2$, $Co_3O_4$, $MnO_2$, $MnS_2$, etc.

The pigment layer of the recording element of the invention may also contain an ultraviolet-absorbing dye, such as a benzotriazole, a substituted dicyanobutadiene, an aminodicyanobutadiene, or materials such as those disclosed in Patent Publications JP 58/62651; JP 57/38896; JP 57/132154; JP 61/109049; JP 58/17450; or DE 3,139,156, the disclosures of which are hereby incorporated by reference. They may be used in an amount of from about 0.05 to about 10 $g/m^2$.

The recording elements of this invention can be used to obtain medical images, reprographic masks, printing masks, etc. The image obtained can be a positive or a negative image. The process of the invention can generate either continuous (photographic-like) or halftone images.

The invention is especially useful in making reprographic masks which are used in publishing and in the generation of printed circuit boards. The masks are placed over a photosensitive material, such as a printing plate, and exposed to a light source. The photosensitive material usually is activated only by certain wavelengths. For example, the photosensitive material can be a polymer which is crosslinked or hardened upon exposure to ultraviolet or blue light, but is not affected by red or green light. For these photosensitive materials, the mask, which is used to block light during exposure, must absorb all wavelengths which activate the photosensitive material in the Dmax regions and absorb little in the Dmin regions. For printing plates, it is therefore important that the mask have high blue and UV Dmax. If it does not do this, the printing plate would not be developable to give regions which take up ink and regions which do not.

By use of this invention, a mask can be obtained which has enhanced stability to light for making multiple printing plates or circuit boards without mask degradation.

Any polymeric material may be used as the binder in the recording element employed in the invention. For example, there may be used cellulosic derivatives, e.g., cellulose nitrate, cellulose acetate hydrogen phthalate, cellulose acetate, cellulose acetate propionate, cellulose acetate butyrate, cellulose triacetate, a hydroxypropyl cellulose ether, an ethyl cellulose ether, etc.; gelatin; polycarbonates; polyurethanes; polyesters; poly(vinyl acetate); polystyrene; poly(styrene-co-acrylonitrile); a polysulfone; a poly (phenylene oxide); a poly(ethylene oxide); a poly(vinyl alcohol-co-acetal) such as poly(vinyl acetal), poly(vinyl alcohol-co-butyral) or poly(vinyl benzal); or mixtures or copolymers thereof. The binder may be used at a coverage of from about 0.1 to about 5 $g/m^2$.

A barrier layer may be employed in the laser recording element of the invention if desired, as described in U.S. Pat. No. 5,459,017, the disclosure of which is hereby incorporated by reference.

To obtain a laser-induced image according to the invention, an infrared diode laser is preferably employed since it offers substantial advantages in terms of its small size, low cost, stability, reliability, ruggedness, and ease of modulation.

The recording element of the invention may also contain an infrared-absorbing material such as cyanine infrared-absorbing dyes as described in U.S. Pat. No. 4,973,572, or other materials as described in the following U.S. Pat. Nos.: 4,948,777; 4,950,640; 4,950,639; 4,948,776; 4,948,778; 4,942,141; 4,952;552; 5,036,040; and 4,912,083, the disclosures of which are hereby incorporated by reference. The laser radiation is then absorbed into the recording layer and converted to heat by a molecular process known as internal conversion. As used herein, an infrared-absorbing dye has substantial light absorbtivity in the range between about 700 nm and about 1200 nm. In one embodiment of the invention, the laser exposure in the process of the invention takes place through the dye side of the recording element, which enables this process to be a single-sheet process, i.e., no separate receiving element is required.

Lasers which can be used in the invention are available commercially. There can be employed, for example, Laser Model SDL-2420-H2 from Spectra Diode Labs, or Laser Model SLD 304 V/W from Sony Corp.

Any material can be used as the support for the recording element of the invention provided it is dimensionally stable and can withstand the heat of the laser. Such materials include polyesters such as poly(ethylene naphthalate); polysulfones; poly(ethylene terephthalate); polyamides; polycarbonates; cellulose esters such as cellulose acetate; fluorine polymers such as poly(vinylidene fluoride) or poly (tetrafluoroethylene-co-hexafluoropropylene); polyethers such as polyoxymethylene; polyacetals; polyolefins such as polystyrene, polyethylene, polypropylene or methylpentene polymers; and polyimides such as polyimide-amides and polyether-imides. The support generally has a thickness of from about 5 to about 200 μm.

A thermal printer which uses a laser as described above to form an image on a thermal print medium is described and claimed in U.S. Pat. No. 5,168,288, the disclosure of which is hereby incorporated by reference.

Image dyes could also be added to the recording layer of the invention such as those dyes disclosed in U.S. Pat. Nos. 4,541,830; 4,698,651; 4,695,287; 4,701,439; 4,757,046; 4,743,582; 4,769,360; and 4,753,922, the disclosures of which are hereby incorporated by reference.

The following examples are provided to illustrate the invention.

EXAMPLE 1 (E-1)

Cupric oxide (Johnson Mathey Corp.) (20.00 g) was added to a warm solution of 2.0 g gelatin dissolved in 100 g $H_2O$. After agitation, the mixture was poured into a 500 cc glass container which contained 300 g of 2.0 mm glass beads. The mixture was then ball-milled on a paint shaker for 4 hours. The milled mixture was freed from the glass beads and diluted with 50–100 ml $H_2O$, 0.5 ml of hardener (HAR-2088, Eastman Kodak Co.) and 3 drops of a surfactant (Triton-X® 100, 10% by weight in $H_2O$) were added while the dispersion was kept warm at 40° C.

The dispersion was then coated onto 125 μm clear gelatin-subbed Estar® poly(ethylene terephthalate) film (Eastman Chemical Co.) using a 25 μm doctor blade.

EXAMPLE 2 (E-2)

Cupric oxide (Johnson Mathey Corp.) (10.00 g) was added to a solution of 2.70 g cellulose nitrate (5.2 s viscosity) in 100 ml acetone. The mixture was milled on a paint shaker using 2.0 mm glass beads. After milling, the mixture was freed from the glass beads and coated unto 175 μm Estar® using a 75 μm doctor blade.

EXAMPLE 3 (E-3)

Example 3 was carried out in an identical manner to that of Example 2 except that, in addition, 0.220 g of aluminum chloride phthalocyanine infrared-absorbing dye was added to the dispersion before milling.

Comparison Example 1 (CE-1)

As a comparison example, an exposed sheet of silver halide laser print film (HN-10, Eastman Kodak Co.) was used.

Printing

Coatings were evaluated on a drum scanner system consisting of a 12.75 cm drum~10 cm long. The samples were mounted on the outside surface of the drum. The rotational speed of the drum could be varied from a speed of 1 to 800 rev/min. An 827 nm diode laser was aimed perpendicular to the drum surface, and was focused to a 6 μm by 8 μm $1/e^2$ full width spot at the sample surface. The laser power could be varied from 0 to 100 mW. The pitch of the scan was 5 μm for all rotational speeds. The focal position of the laser was adjusted to account for any variances in substrate thickness. In general, experiments and comparison example experiments were performed at identical laser power and the "writing" speed determined by comparing the change in optical densities at various drum rotational speeds.

Visible optical densities were measured on a transmission densitometer purchased from X-Rite, Inc., Grand Rapids, Mich. Average densities and the individual red, green and blue densities were measured. Differences between individual color densities minus the average density were determined as follows:

TABLE I

| EXAMPLE | Red O.D. − Ave. O.D. | Green O.D. − Ave. O.D. | Blue O.D. − Ave. O.D. | Writing Speed (rev/min.) |
|---|---|---|---|---|
| E-1 | −0.04 | 0.02 | 0.09 | 120 |
| E-2 | −0.04 | 0.00 | 0.05 | 240 |
| E-3 | 0.13 | −0.13 | 0.00 | 480 |
| CE-1* | 0.03 | −0.08 | 0.01 | — |

*The optical density of the blue Estar ® base was subtracted from the optical density of the film to allow for a direct comparison.

The above results show that the relatively neutral tone scale distribution of the examples matches that of the silver halide comparison media very closely. The results further show that the overall writing speed is dependent somewhat upon the binder material employed and that the writing speed can be further improved by the addition of a suitable laser absorbing pigment such as aluminum chloride phthalocyanine.

EXAMPLE 4 (E-4)

To a 3.5% by weight solution of 826 s. cellulose nitrate (Hercules Inc.) dissolved in an 80:20 (w/w) mixture of methyl isobutyl ketone/ethanol, which contained also a mixture of visible and infrared dyes, as described in U.S. Pat. No. 5,503,956, to gird a near neutral black coating dispersion, was added 0.123 g of CuO having a particle size of <2 μm. The concentrations were chosen such that the weight ratio of CuO to binder plus dyes was 1:2. An additional 2 ml of a 77:23 (w/w) n-propyl acetate/ethanol mixture was added and the dispersion was thoroughly mixed on a paint shaker. The dispersion was then coated onto a 175 μm thick clear Estar® support using a 25 μm blade to a dried coating of the dispersion with an average optical density in the visible of about 3.00.

EXAMPLE 5 (E-5)

This experiment was carried out in an identical manner to that of Example 4, except that the amount of CuO added to the dispersion was 0.246 g and the concentrations were adjusted such that the weight ratio of CuO to binder plus dyes was 1:1.

EXAMPLE 6 (E-6)

The experiment Was carried out in an identical manner to that of Example 4, except that the amount of CuO added to the dispersion was 0.492 g and the concentrations were adjusted such that the weight ratio of CuO to binder plus dyes was 2:1.

Comparison Example 2 (CE-2)

The experiment was carried out in an identical manner to that of Example 4 except that no amount of CuO was added to the dispersion.

Specular Reflection

The degree of specular reflection of samples was determined by taking the difference between the total reflectance and diffuse reflectance measured in the visible region (400–700 nm) relative to a $BaSO_4$ standard. The coating was then mounted on a rotating drum and subjected to laser irradiation as detailed above while the dram was rotating at a speed of 360 rev/min. The optical density in the exposed and unexposed areas were measured with the difference giving the rate of material ablation at constant laser power exposure. The results are given in the following Table:

TABLE II

| EX. | Weight Ratio CuO/ (binder + dyes) | Ave. O.D. as Coated | O.D. in Exposed area | (Ave. O.D.) − (O.D. exposed area) | % Specular Reflection |
|---|---|---|---|---|---|
| E-4 | 1:2 | 3.20 | 0.15 | 3.05 | <1% |
| E-5 | 1:1 | 3.02 | 0.18 | 2.84 | NM* |
| E-6 | 2:1 | 2.63 | 1.34 | 1.29 | 0% |
| CE-2 | 0 | 3.04 | 0.11 | 2.93 | 6.0% |

*NM = Not Measured

The above results show that the recording elements of the invention had less specular reflection than that of the comparison element without any pigment, while maintaining ablation rate or with only a slight reduction in ablation rate.

Determination of Lightbox Stability

In order to determine their relative lightbox stability, pieces of the coatings were cut from Examples 4–6 and Comparison Example 2 and exposed to light from a lightbox (Picker Co.). The average optical density and the red optical densities of each of the samples were then monitored at specific time intervals. The average optical density and the red optical density after five days exposure to actinic radiation from the lightbox were as follows:

TABLE III

| EXAMPLE | Weight Ratio CuO/ (binder + dyes) | Ave. O.D. as Coated | Ave. O.D. after 5 days | Red O.D. after 5 days |
|---|---|---|---|---|
| E-4 | 1:2 | 3.20 | 2.27 | 2.24 |
| E-5 | 1:1 | 3.02 | 2.27 | 2.08 |
| E-6 | 2:1 | 2.63 | 2.18 | 2.16 |
| CE-2 | 0 | 3.04 | 1.76 | 1.46 |

The above results show that the recording elements of the invention had better image stability overall and better retention of image tone, as evidenced by the reduced loss in red optical density, than that of the comparison element without any pigment.

EXAMPLE 7 (E-7)

Magnetite (Toda Kogyo Corp.) (10.00 g) was added to a solution of 7.14 g cellulose nitrate (5.2 s viscosity) in 10.00 ml methyl ethyl ketone and 0.100 g aluminum chloride phthalocyanine. The mixture was then milled on a paint shaker using 2.0 mm glass beads. After milling, the mixture was freed from the glass beads and coated unto 175 μm Estar® using a 75 μm doctor blade. The coating had an average optical density of 3.23 and could be fully ablated at a drum rotational speed of 240 rev/min. These results show that it is possible to employ other pigments as ablative media.

EXAMPLE 8 (E-8)

$Cu(OH)_2$ (5.25 g), (Johnson Mathey Corp.) was thoroughly mixed with 1.00 g sodium acetate trihydrate by slurrying the two in distilled water. The mass was then dried at 100° C. in an alumina crucible and fired at 400° C. in air for 4 hours. The solid was deep blue-black in color.

Comparison Example 3 (CE-3)

$Cu(OH)_2$ (Johnson Mathey Corp.) was placed into an aluminum crucible and fired and handled in an identical manner to that of Example 8 except that it was not treated with sodium acetate trihydrate. The solid obtained in this manner was brown-black in color.

The above results for E-8 and CE-3 show that an alkali treatment of the cupric oxide resulted in a pigment with a better image tone which would be useful for medical imaging.

The invention has been described in detail with particular reference to preferred embodiments thereof, but it will be understood that variations and modifications can be effected within the spirit and scope of the invention.

What is claimed is:

1. A process of forming a relatively neutral ablation image for a medical imaging film having an image tone resembling that of silver halide comprising a) imagewise-exposing, by means of a laser, in the absence of a separate receiving element, a thermal recording element comprising a support having thereon a pigment layer comprising a pigment dispersed in a polymeric binder, said pigment absorbing at the wavelength of a laser used to expose said element, wherein said pigment comprises the formula:

$$M_xA_yQ_z$$

wherein:

M is copper,

A is at least one alkali metal,

Q is at least one of oxygen or sulfur, x is an integer between 1 and 3, y is between 0 and about 2, and z is between about 1 and about 4;

said laser exposure taking place through the pigment side of said element, thereby imagewise-heating said pigment layer and causing it to ablate; and b) removing the ablated material to obtain said relatively neutral ablation image in said thermal recording element.

2. The process of claim 1 wherein A is lithium, sodium or potassium.

3. The process of claim 1 wherein Q is oxygen.

4. The process of claim 1 wherein x and z are each 1 and y is 0.

5. The process of claim 1 wherein said pigment is cupric oxide.

6. The process of claim 1 wherein said pigment is present in an amount of from about 0.05 $g/m^2$ to about 10 $g/m^2$ of said element.

* * * * *